United States Patent [19]

Wilson

[11] 4,122,678

[45] Oct. 31, 1978

[54] HYDRAULIC CONTROL WITH FEEDBACK FOR POWERED MACHINERY

[76] Inventor: Mahlon T. Wilson, 5 Erie La., Los Alamos, N. Mex. 87544

[21] Appl. No.: 799,695

[22] Filed: May 23, 1977

[51] Int. Cl.[2] ..... F15B 7/00

[52] U.S. Cl. ..... 60/571; 60/572; 214/DIG. 2; 214/1 CM

[58] Field of Search ..... 60/388, 533, 571, 572, 60/581, 584, 592; 214/DIG. 2, 1 CM

[56] References Cited

U.S. PATENT DOCUMENTS

| | | | |
|---|---|---|---|
| 2,426,695 | 9/1947 | Kremiller | 60/572 X |
| 3,524,562 | 8/1970 | Fuzzell | 214/762 |
| 3,534,881 | 10/1970 | Horsch | 214/762 |
| 3,614,273 | 10/1971 | Wallace | 214/778 |
| 3,642,159 | 2/1972 | Askins | 214/764 |
| 3,695,377 | 10/1972 | Ito et al. | 180/66 B |
| 3,880,304 | 4/1975 | Strickland | 214/1 CM X |

*Primary Examiner*—Edgar W. Geoghegan
*Attorney, Agent, or Firm*—Paul D. Gaetjens

[57] ABSTRACT

A three-cylinder hydraulic system providing position feedback for controlling powered machinery is described wherein an operator moves a control handle and the various working elements of the machinery respond to follow the path of the control handle, the freedom of movement of which is limited by the ability of the machinery to respond. The system consists of a control station comprised of an assemblage of linkages resembling the machinery to be controlled. Associated with each movable element on both the control station and machine, and with each lever or switch on the machine, are double-acting hydraulic cylinders or rotary actuators. The three cylinders thereby associated with each particular working element and its actuation are connected hydraulically so that the control station cylinder hydraulically manipulates the cylinder that moves the lever or switch that actuates that working element on the machine. The cylinder on that working element on the machine in turn hydraulically manipulates both the control station cylinder and the cylinder that moves the lever or switch. The control station may be located either upon the machinery or at a position remote from the machinery.

11 Claims, 7 Drawing Figures

HYDRAULIC CONTROL WITH FEEDBACK FOR POWERED MACHINERY

BACKGROUND OF THE INVENTION

1. Field of the Invention

This invention generally relates to a means whereby an operator controls a machine, for example, the control of an earth working back-hoe digger. The operator is typically located upon the machine and operates it through pushing or pulling numerous levers arranged before him. Each lever usually activates only one motion of the many required to perform useful work. The operator must be trained as to the functions of each lever and must concentrate upon the sequence and degree of actuation required to obtain the desired motions. Improper sequencing or over-actuation can cause accidents such as load dropping or striking objects. Efficiency and speed of operation are very dependent upon operator skill at manipulating this multiplicity of levers with split-second timing.

2. Prior Art

This control problem has been recognized in previous inventions. Askins (U.S. Pat. No. (3,642,159) utilizes one manually operated valve, linkages, and a pneumatic circuit to sequence movements on a shovel loader. Wallace (U.S. Pat. No. 3,614,273) controls the boom arms and bucket on a front-end loader through one control handle, linkages, and three valves, providing sequential operation. Fuzzell (U.S. Pat. No. 3,524,562) controls the bucket of a loader by means which electrically release a detent which is holding the control valve at a given setting. Horsch (U.S. Pat. No. 3,534,881) utilizes linkages connected to the control valve to maintain bucket position during raising and lowering. These inventions all relate to a relatively simple machine utilized to perform repetitive operations. The operator cannot interrupt the sequence at will and quickly, and he must be seated upon the equipment. Ito and Aihara (U.S. Pat. No. 3,695,377) remotely control a tractor through electrical signals sent through a control cable to operate relays and electropneumatic actuators connected to the various tractor controls.

3. Utility

The operator of farming, mining, or earth-moving machinery often finds himself in a noisy, dusty (or wet), vibrating, and generally unpleasant environment. He may not be in the best location to observe the results of his actions. He may also be in physical danger such as cave-ins when working in tunnels, at the base of cliffs, or in excavations; his machine could tumble down steep slopes or have the ground give way beneath him when working around excavations; he may be in toxic or inflammable environments; or he might accidentally sever high pressure pipes or contact high voltage lines. This invention allows the operator to move his operating controls to a location away from the equipment and operate the equipment by actuating a size-scaled version of the movably connected portions of the equipment with the actual equipment mimicking his motions. A feedback feature restricts the operator's motions when the equipment is incapable of following within certain limits. In many cases it is not desirable to remove the operator from the machine. The use of a vehicle mounted control station provides the improved control inherent with this system, thereby enhancing the efficiency of the operation.

SUMMARY OF THE INVENTION

This invention describes a three-cylinder control system for powered machinery in which a master cylinder attached to a particular linkage at the control station is connected hydraulically with a slave cylinder attached to the corresponding working element on the machinery and also to a control cylinder that is attached to the machinery lever that actuates that particular working element on the machinery. With the machinery power turned off, the master cylinder timing valves are opened and the control station handle is manipulated until the control station linkages have the same geometrical configuration as the machinery, at which point the master cylinder timing valves are closed. A movement of the control station handle moves one or more of the master cylinder pistons, forcing fluid into the control cylinders since the slave pistons have not moved. The control cylinder pistons move the original equipment levers, powering the machinery, thereby moving the slave cylinders, forcing their fluid into the control cylinders, and returning the control pistons to their centered positions. This returns the original equipment control levers to the neutral position and stops the motion of the machinery so that it corresponds to the new position of the linkages on the control station. By moving the control station handle in the desired fashion, the machinery is directed to follow without the operator having to think about the control of each motion.

DESCRIPTION OF THE PREFERRED EMBODIMENT

A control station, either mounted on the machine or at a remote location, for the working elements of the machinery, is constructed to a scale convenient for the operator. The station may incorporate a counterweighting system and motion locks. To each rotating or sliding linkage on both station and machine are mounted double-acting hydraulic cylinders or rotary actuators. Those on the station are called master cylinders and those on the equipment are called slave cylinders. A third set of double-acting cylinders, called control cylinders, are used to push or pull the original machinery control levers. Tubing is used to connect the various cylinders together. Timing and locking valves can be provided to permit positioning the pistons of the various cylinders with respect to each other. Accumulators can pressurize the system and enable the system to withstand temperature variations. The hydraulic system is filled with any low viscosity fluid as the force and displacement working medium.

Figure 1:
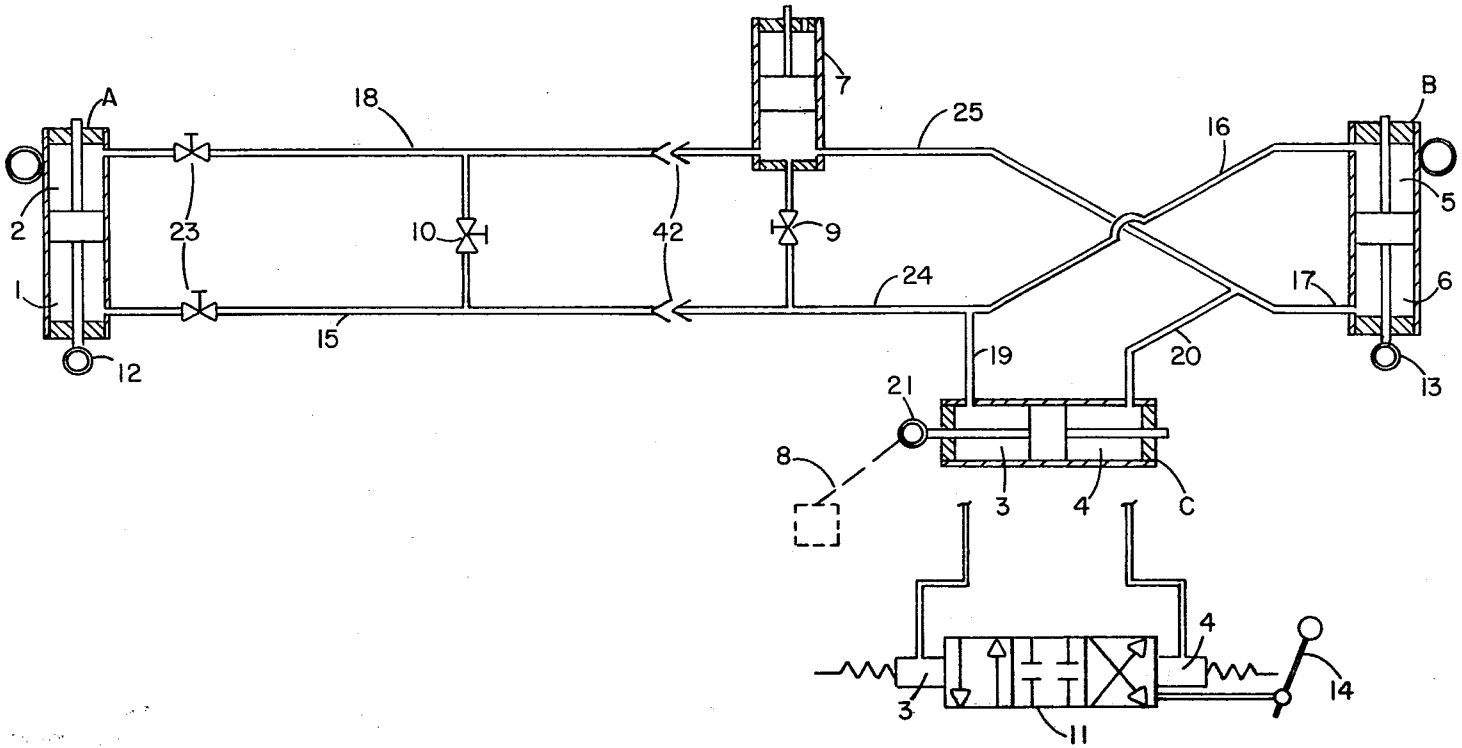
FIG. 1 is a schematic view of the three-cylinder system of this invention and also shows an alternate to the control cylinder.

As shown in FIG. 1, master cylinder A with push rod 12 displaces fluid volumes 1 and 2 such that fluid is forced from volume 1 into volume 3 of control cylinder C by means of tubes 15, 24, and 19. Fluid from volume 1 also attempts to enter volume 5 of slave cylinder B via tubes 15, 24, and 16; however, volume 5 is fixed because slave cylinder piston rod 13 cannot move since it is attached to the machinery which has not yet moved. The increase in fluid in volume 3 forces fluid from volume 4 through tubes 20, 25, and 18 into volume 2; therefore, control cylinder piston rod 21 is slaved to follow master cylinder piston rod 12. The movement of control cylinder piston rod 21 actuates valve lever 8 which in turn through the normal hydraulic or electric system of the machine moves a linkage on the machine. By moving lever 8, a corresponding motion is generated in the linkage of the machinery. The movement of the linkage creates a movement of slave cylinder piston rod 13 causing the fluid in volume 6 to be displaced through tubes 17 and 20 into volume 4 of the control cylinder C. Increased fluid in volume 4 causes fluid to flow from volume 3 through tubes 19 and 16 into volume 5. Volumes 3 and 4 are equalized in cylinder C moving lever 8 to a central position which stops the motion of the linkage. Continued motion of master cylinder piston rod 12 keeps control cylinder C in an unequalized position which continues the motion of the linkage until such time as the slave cylinder piston rod 13 is in a corresponding position with master cylinder piston rod 12. Should the linkage be unable to move because of striking an object or reaching its mechanical limit, master cylinder piston rod 12 will be prevented from further motion. This provides position feedback to the operator. A timing valve 10 may be provided to allow flow between volume 1 and volume 2 so as to permit the control station linkages to be placed in a configuration similar or relative to the working elements of the machinery, thereby enabling the control station to have the same geometric configuration as the machinery, or a configuration that is more comfortable to the operator rather than a true geometric configuration of the machinery. An additional timing valve 9 may be provided to allow free flow of fluid between volumes 5 and 6 and volumes 3 and 4, thus permitting the normal operation of the equipment through manual actuation of lever 8. Closing valves 23 hydraulically lock the master cylinder piston rod 12 to hold the position of the linkage. Quick disconnect couplings 42 may be provided on the machine to facilitate convenient removal of the remote portions of the circuit. The control cylinder C is intended to be used as a retrofit to existing equipment. For original equipment installation on hydraulic machines, it is more practical to incorporate a pilot operated valve 11 in the basic construction of the machine's hydraulic system. This valve 11 would still have a lever actuator 14 to permit conventional manual operation.

Figure 2:
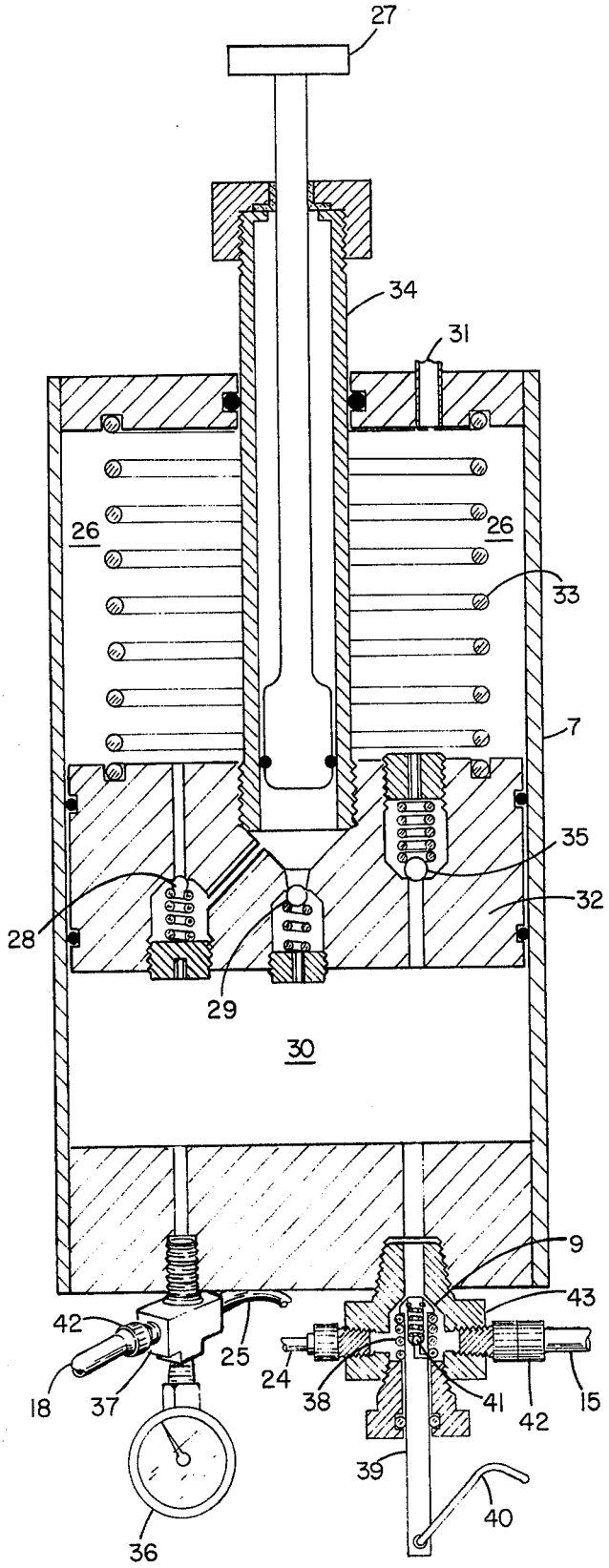
FIG. 2 is a partial cross-sectional view of the accumulator shown in FIG. 1.

A fluid pressurization system may be provided by accumulator 7. The accumulator is shown in partial cross-sectional detail in FIG. 2. The accumulator 7 provides means to maintain pressurization in the system, and an expansion volume to accommodate system temperature fluctuations. Other desirable features of this accumulator are that it provides the following functions:

a. rigid location to attach the hydraulic lines from a remote control station,
b. includes a pump means to increase the system pressure,
c. a visual means of indicating fluid level in the system,
d. incorporates overpressure relief to reduce the possibility of equipment damage due to operator attempting to overload control station,
e. incorporates timing valve 9 at a convenient location on the machine, allowing the machine to be operated manually when the control station is disconnected,
f. incorporates air venting means,
g. and fluid pressure gage.

Accumulator 7 is provided fluid from a reservoir by gravity feed through tube 31 into volume 26. Raising plunger 27 by hand draws fluid from volume 26 past check valve 28. Manual depression of plunger 27 forces the fluid past foot valve 29 into volume 30. Volume 30 is connected to the system through lines 15, 24, 18, and 25. Continued pumping of plunger 27 fills volume 30 raising piston 32 against spring 33. The spring 33 provides a force on the fluid in volume 30. The vertical position of piston 32 is indicated by the extent of the height of pump housing 34 above the top of the accumulator 7. Air trapped in volume 30 is expelled through pressure relief valve 35 into volume 26 where it raises through tube 31 into the fluid storage reservoir (not shown). The system pressure is indicated by gage 36 after all air is bled from all parts of the system. Volume 30 communicates with tubes 18 and 25 through fitting 37. Tubes 15 and 24 communicate with each other through fittng 43, but do not communicate with volume 30 since timing valve 9 is closed. Pulling plunger 39 of timing valve 9 and holding it open with wire clip 40 allows the free communication of fluid between tubes 24 and 25 (also tubes 15 and 18) through volume 30. On the occasion of overpressure of tubes 17, 25, and 18, fluid will flow into volume 30 and may vent through valve 35 and/or force down plunger 39 against spring 38 allowing fluid to pass into tubes 15 and 24. Overpressurization of tubes, 15, 16, and 24 is relieved through valve 41 through volume 30 into tubes 18 and 25 and/or out through valve 35.

Figure 3:
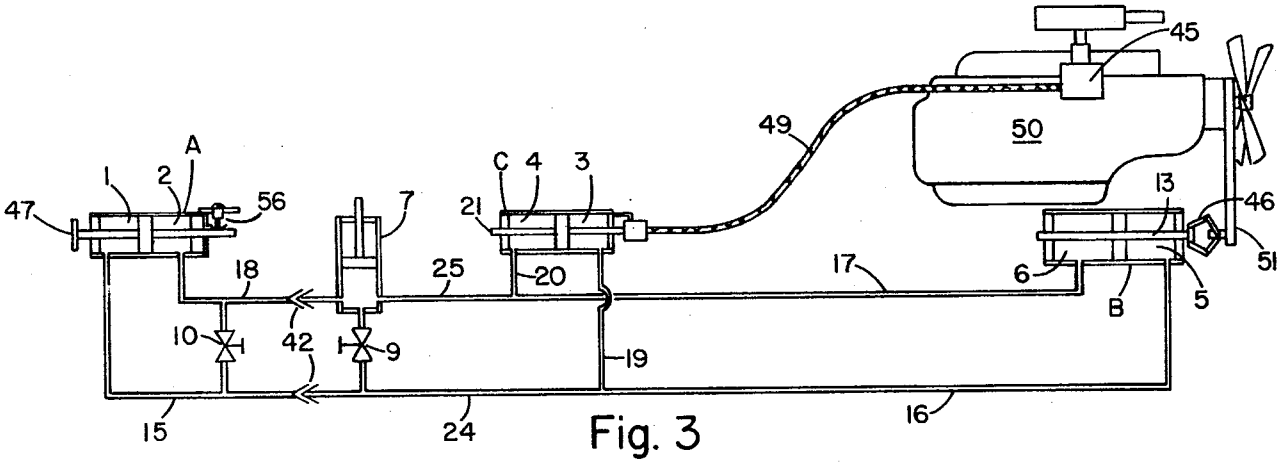
FIG. 3 is a schematic of a throttle control system which employs the hydraulic control system shown in FIG. 1.
Figure 4:
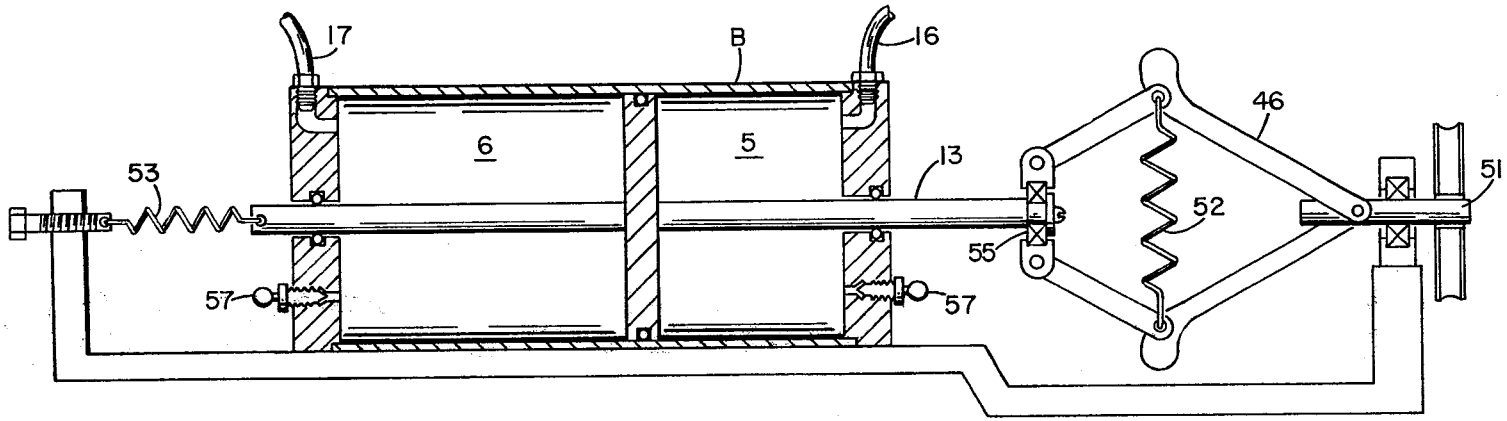
FIG. 4 is a partial, cross-sectional view of the enlargement of the slave cylinder shown in FIG. 3.

One particular embodiment of this invention useful as a control system for an engine is shown in FIGS. 3 and 4. FIG. 3 is a schematic of the throttle control, while FIG. 4 is an enlargement of the slave cylinder B of FIG. 3. When remotely advancing a throttle, a question always exists as to the actual engine speed since that is a function of engine load as well as throttle setting. Use of the basic three-cylinder control system of FIG. 1 relieves this problem. In this case, the control cylinder piston rod 21 is connected to the throttle 45 and the position of slave cylinder piston rod 13 is determined by the length of an engine-driven flyball inkage 46. Advancing the remote throttle 47 displaces fluid from volume 2 through tubes 18, 25, and 20 into volume 4 of the control cylinder C. This displaces the piston rod 21 and the throttle linkage 49 connected to it. The engine 50 will spend up and the engine-driven shaft 51 will rotate faster, causing the weighted linkages 46 to separate by centrifugal force. The centrifugal force is balanced by the force of a spring located at 52 and/or 53. The separation of the linkages 46 in response to the larger centrifugal force reduces the distance between the engine-driven shaft 51 and the swivel bearing 55, thereby moving the piston rod 13 of the slave cylinder B, displacing fluid from volume 5 through tubes 16 and 19 into volume 3 of the control cylinder C, retarding the throttle 45. As the engine 50 slows in response to the new throttle setting, the flyball linkages 46 are pulled together by the springs 52 and/or 53, displacing fluid from volume 6 through tubes 17 and 20 into volume 4, thereby advancing the throttle 45. The tubes and volumes are sized to provide a damping to this oscillatory behavior and the engine settles to a consant speed determined by the fluid distribution set by the remote throttle 47. An increase in load will slow the engine, thereby displacing the fluid from volume 6 into volume 4 as before, advancing the throttle 45. A reduction of load has the opposite effect. Should the engine stop due to stalling or running out of fuel, the piston rod 13 of slave cylinder B would move to its extreme, forcing much of the fluid from volume 6 through tubes 17 and 20. Volume 4 of the control cylinder C is not large enough to accept this much fluid so it will flow into volume 2 of the master cylinder A, forcing piston rod 47 to move within its friction position holder 56, indicating to the operator that the engine speed has decreased below a controllable level. Valves 57 permit the bleeding of air from slave cylinder B and are present but not shown on all the cylinders and other locations wherever air could be trapped.

Figure 5:
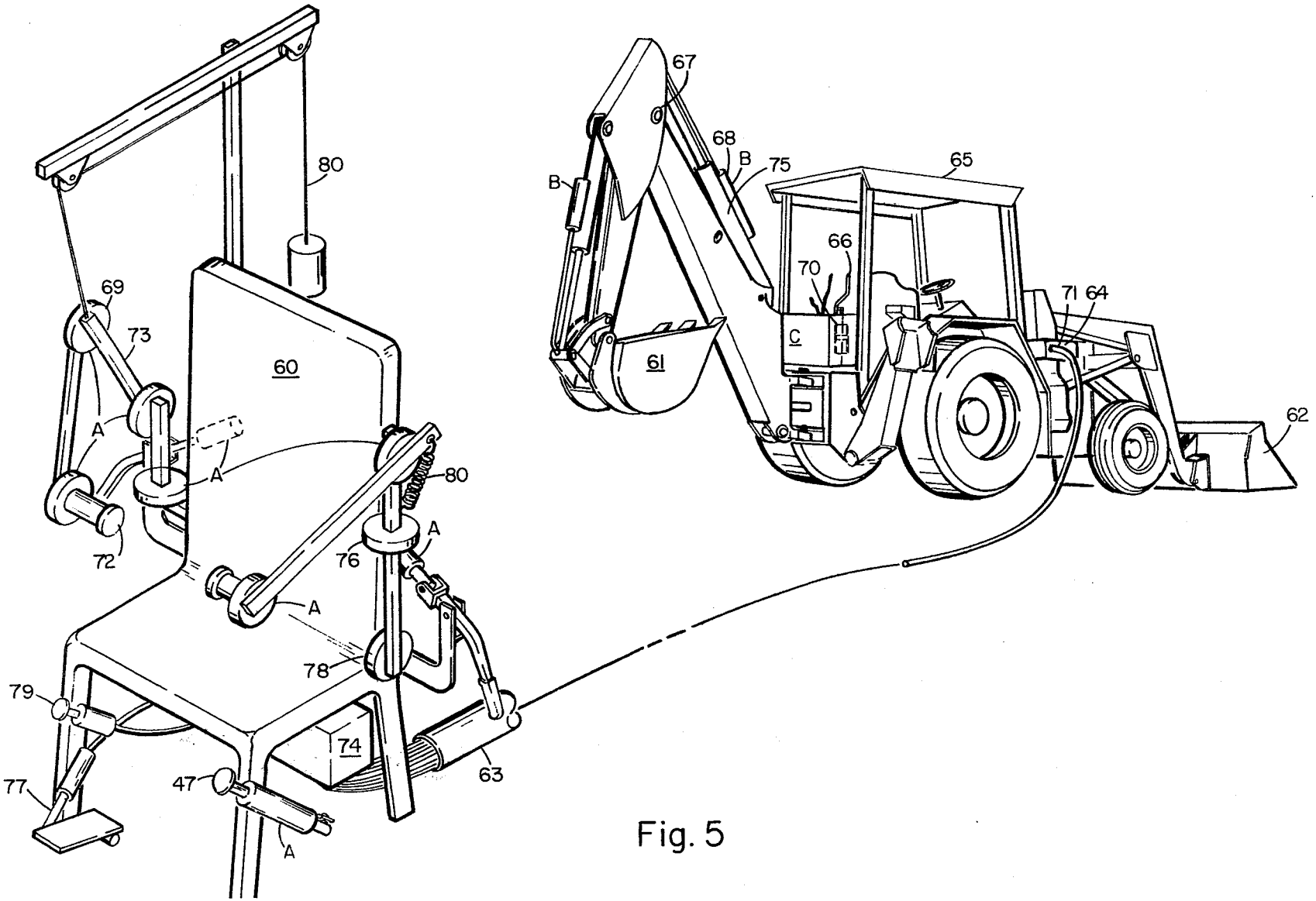
FIG. 5 is a perspective view of a remote station controlling a wheel-backhoe using multiple control systems of the type shown in FIG. 1.

An example of a remote control station using the system of this invention is shown in FIG. 5. Multiple master, control, and slave cylinders provide this control although only one control and two slave cylinders are shown on the machinery for sake of simplicity. FIG. 5 is a perspective view of a remote control station 60 controlling a wheel-backhoe 65 with bucket attachment 62. The control station 60 is connected to machine 65 by means of a bundle of hydraulic tubes 63 which connect to the machine by means of rack 64 in which are mounted multiple accumulators (not shown). All master cylinders A are located on control station 60, and some of these master cylinders are shown as rotary actuators instead of as cylinders. Slave cylinders B are located on machine 65, and control cylinders C are located on machine 65 mechanically connected to levers 66. One sample operation is as follows: Associated with actuation of working element 67 is slave cylinder 68, master cylinder 69, and control cylinder 70, and accumulator 71 mounted on rack 64. While sitting at control station 60 the operator pulls handle 72 toward him which causes pivotal motion which displaces fluid from master rotary actuator 69 incorporated in the linkages. The fluid is displaced through tubes enclosed in the structural member 73 to manifold block 74, hence through tube bundle 63 to accumulator 71, to control cylinder 70, and slave cylinder 68. The displaced fluid moves a piston in control cylinder 70, actuating lever 66 which powers a piston in cylinder 75 causing motion about working element 67, resulting in motion of a piston in slave cylinder 68, displacing fluid which causes revers motion of the piston in control cylinder 70 which returns lever 66 to a neutral position stopping the piston in cylinder 75. Continued pulling of handle 72 will continue the displacement of the piston in control cylinder 70 and actuation of control lever 66 and power cylinder 75, resulting in continued motion of working element 67. Each linkage on the machine is controlled by a master A, control C, and slave B cylinder in a similar hookup. Control station 60, as depicted in FIG. 5, shows control means of all functions of the backhoe. Every working element on the machine that is hydraulically controlled is shown on control station 60. In addition, the throttle 47 is hydraulically controlled using the three-cylinder system of this invention (see FIGS. 3 and 4). The other control features, namely, braking 77, steering 76, gear shifting 78, and starting 79 are two-cylinder operations (not part of this invention) and are shown only to depict a complete remote control station. For operator comfort, possible counterbalancing means 80 are shown schematically, relieving the dead weight of the master system linkages.

Figure 7:
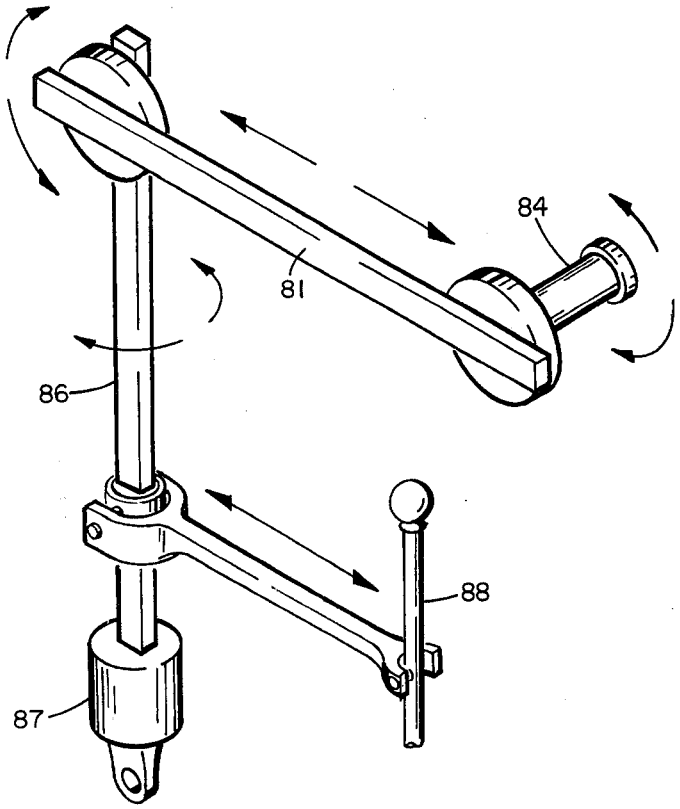
FIG. 7 is a perspective view of the enlargement of the control station shown in FIG. 6.
Figure 6:
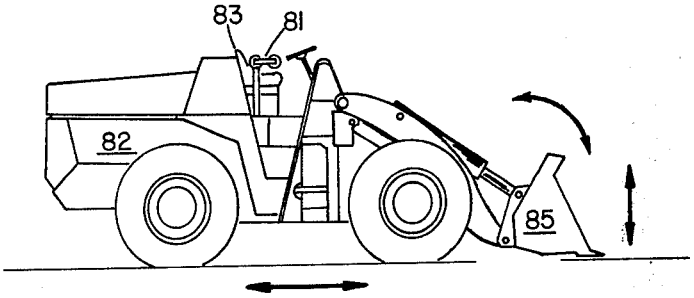
FIG. 6 is a side view of the control station mounted on a vehicle using the control system of the type shown in FIG. 1.

FIG. 6 depicts the control station 81 and FIG. 7 is an enlargement of same mounted on vehicle 82. The operator sitting in the vehicle seat 83 has handle 84 in his hand. The valves which cause bucket curl and lift both are controlled by systems of the type shown in FIG. 1. Lifting handle 84 results in raising bucket 85. Rotating handle 84 results in curl of bucket 85. Swinging handle 84 in the horizontal plane results in turning vehicle 82 since column 86 is connected directly to the vehicle power steering 87. Forward and reverse control of the vehicle 82 is accomplished by pushing or pulling handle 84 which tilts column 86 actuating transmission lever 88. Vehicle's speed and braking are part of the conventional vehicle control system. Having this control system mounted on the vehicle provides the following advantages: (a) less fatigue on the operator, (b) faster operation of the vehicle, (c) less training needed for operator, and (d) better control of operation of the bucket, vehicle, and therefore, enhanced job performance.

While the invention has been described in detail with respect to a specific embodiment, it will be apparent that many variations are possible. Certain of the functions of devices described herein, including the accumulator, timing, and locking valves, may be accomplished by other mechanisms without departing from the scope of the invention. Other modifications are possible and accordingly it is not intended to limit the invention except as defined by the following claims.

What I claim is:

1. A hydraulic control system with position feedback for powered machinery comprising:

(a) a double-acting hydraulic master means, (b) a double-acting hydraulic slave means, (c) a double-acting hydraulic control means, all of said means being hydraulically interconnected, (d) said master means consisting of either a rotary actuator or cylinder which is situate and mechanically connected to a handle at a control station and hydraulically connected with (e) the said control means, consisting of a rotary actuator or cylinder which is situate and is mechanically attached to the lever or is incorporated into the control mechanism that actuates the normal motive power system of the working element of the said machinery, and said control means being hydraulically connected with (f) the slave means, consisting of either a rotary actuator or cylinder which manipulates both the said master and control means, said slave actuator or cylinder being attached on a linkage of the working element of the machinery.

2. The hydraulic control system of claim 1 wherein said system includes at least one timing valve which is in fluid communication across the master, or control, or slave cylinders.

3. The hydraulic control means of claim 1 wherein said means includes one accumulator for each master, control, and slave cylinder combination and maintains pressure within the said system.

4. The accumulator of claim 3 which incorporates a pump means, air venting means, pressure maintenance means, overpressure relief means, and a timing valve external to said accumulator but in fluid communication therewith.

5. The pump means of claim 4 wherein said means includes in series a fluid reservoir, a check valve, a pump plunger, a foot valve, and a pump housing rigidly attached to a piston said piston slidably mounted within the said accumulator and said pump housing passing through the top closure of the said accumulator.

6. The overpressure relief means of claim 4 which includes at least one relief valve.

7. The accumulator of claim 4 in which the timing valve includes two spring loaded sealing elements, each of which channels overpressured fluid around the sealing surface of the other.

8. The air vent means of claim 4 which means include a valve in communication with the said reservoir at the valve's upper terminal and with the pressurized fluid system at the valve's lower terminal.

9. The hydraulic master means of claim 1 in which the said control station is mounted on the said machinery.

10. The hydraulic master means of claim 1 in which the said control station is remote from the said machinery but is hydraulically connected thereto by tubing means.

11. The hydraulic control system of claim 1 wherein the control means is mechanically linked to the throttle of an engine and the slave means is mechanically attached to engine driven spinning linkages.

* * * * *